United States Patent [19]

Tamura

[11] Patent Number: 4,471,332

[45] Date of Patent: Sep. 11, 1984

[54] STATIC INDUCTION APPARATUS

[75] Inventor: Kiyoshik Tamura, Amagasaki, Japan

[73] Assignee: Mitsubishi Denki Kabushiki Kaisha, Tokyo, Japan

[21] Appl. No.: 567,311

[22] Filed: Dec. 30, 1983

[30] Foreign Application Priority Data

Feb. 10, 1983 [JP] Japan ..... 58-21804

[51] Int. Cl.[3] ..... H01F 27/08

[52] U.S. Cl. ..... 336/58; 336/60

[58] Field of Search ..... 336/55, 57, 58, 60, 336/185; 174/15 R

[56] References Cited

U.S. PATENT DOCUMENTS 4,352,078 9/1982 Moone ..... 336/60

*Primary Examiner*—Thomas J. Kozma

*Attorney, Agent, or Firm*—Wenderoth, Lind & Ponack

[57] ABSTRACT

A static induction apparatus has a coil inductively disposed on an iron core and cooled by a condensible refrigerant, the coil including a plurality of pancake coil sections stacked in axially spaced relationship on one another by having a plurality of spacers having a predetermined common height and radially inserted in predetermined equal angular intervals into a gap formed between each said of adjacent coil sections, and a plurality of guide members radially disposed in spaced relationship on the surface of each coil section to alternate the spacers so that the guide members alternately and radially protrude beyond outer and inner peripheral surfaces of the coil sections to receive and introduce the refrigerant into the mating gaps.

3 Claims, 6 Drawing Figures

STATIC INDUCTION APPARATUS

BACKGROUND OF THE INVENTION

This invention relates to improvements in a static induction apparatus cooled by a condensible refrigerant.

A conventional static induction apparatus of the type referred to, for example, a conventional transformer has comprised a core type iron core, an inner coil wound around one leg of the iron core to leave a predetermined annular spacing therebetween, an outer coil wound around the inner coil to form a predetermined annular spacing therebetween, and an annular refrigerant trough fixed to the leg of the iron core to be overspreaded over the upper surfaces of the inner and outer coils and provided at the bottom with a multitude of small holes through which a condensible refrigerant charged in the trough drops on the upper surfaces of the inner and outer coils. Thus the refrigerant has sprinkled over the inner and outer coils heated during the operation to be vaporized whereupon the refrigerant remove a latent heat of vaporization from the heated coils to cool the coils.

Since each of the inner and outer coils has included a plurality of pancake coil sections stacked on one another to form an axial gap between each pair of adjacent coil sections, the sprinkled refrigerant has only trickled down along the inner and outer peripheral surfaces of the stacked coil sections but been difficult to enter the gap between each pair of adjacent coil sections. Thus only the inner and outer peripheral surfaces of each coil section has been cooled but the opposite surfaces thereof has been scarcely cooled resulting in the disadvantage that the cooling effect is poor.

Accordingly it is an object of the present invention to provide a new and improved static induction apparatus including a condensible refrigerant exhibiting the high cooling effect.

SUMMARY OF THE INVENTION

The present invention provides a static induction apparatus comprising an iron core, at least one coil wound around a leg of the iron core and cooled by a condensible refrigerant sprinkled thereon, the coil including a plurality of pancake coil sections axially stacked on one another to form a predetermined gap between each pair of adjacent coil sections, and a plurality of guide members radially disposed at predetermined equal intervals on the surface of each of the coil sections except for the uppermost coil section so that the guide members disposed on alternate ones of the coil sections radially protrude beyond one of outer and inner peripheral surfaces thereof and the guide members disposed on the remaining coil sections radially protrude beyond the other of the outer and inner peripheral surfaces thereof, each of the guide members receiving drops of the refrigerant to introduce the received refrigerant into the predetermined gap between an associated pair of adjacent coil sections.

In a preferred embodiment of the present invention, each of the guide member may be in the form of a rectangular strip, and one end portion thereof radially protruding the peripheral surface of the mating coil section includes side walls surrounding the same except for a side thereof facing the other end thereof to form a reception area having a predetermined height to receive the drops of the refrigerant, and a plurality of spacers in the form of rectangular strips are radially disposed at predetermined equal angular intervals between each pair of adjacent coil sections to maintain the predetermined gap therebetween, the plurality of spacers alternating the associated guide members.

BRIEF DESCRIPTION OF THE DRAWING

The present invention will become more readily apparent from the following detailed description taken in conjunction with the accompanying drawing in which.

DESCRIPTION OF THE PREFERRED EMBODIMENTS

Figure 1:
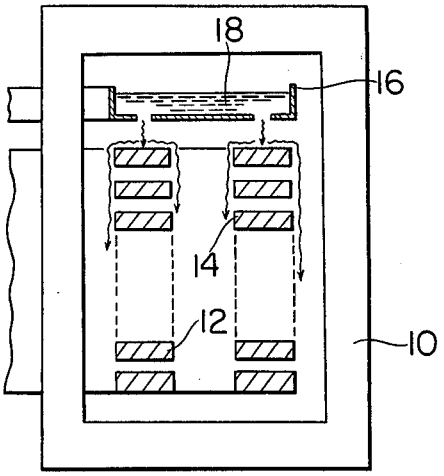
FIG. 1 is a front elevational view of a conventional static induction apparatus with parts illustrated in longitudinal section and with parts omitted.
Figure 2:
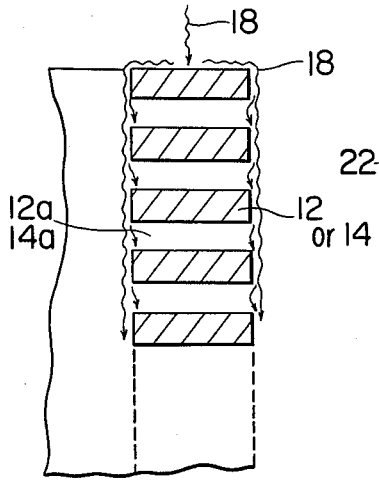
FIG. 2 is a fragmental front elevational view in an enlarged scale of one portion of the arrangement shown in FIG. 1 with parts omitted.

For a better understanding of the nature of the present invention, a conventional static induction apparatus will now be described in conjunction with FIGS. 1 and 2 of the drawing. The arrangement illustrated comprises a core type iron core, an inner coil 12 wound around one leg of the iron core 10 to form a predetermined annular spacing, therebetween, and an outer coil 14 wound around the inner coil 12 to form a predetermined annular spacing therebetween. Each of the inner and outer coils 12 and 14 respectively includes a plurality of pancake coil sections with equal dimensions wound around the leg of the iron core 10 and stacked on one another lengthwise thereof with a predetermined gap left between each pair of adjacent coil sections. The gap is designated by the reference numeral and character 12*a* or 14*a* in FIG. 2 wherein there is illustrated the inner or outer coil 12 or 14 respectively with a flow of a refrigerant as will be described later. As shown in FIG. 1 the coil sections of the inner coil 12 are racially aligned with those of the outer coil 14 respectively.

Then an annular trough 16 is suitably fixed to the leg of the iron core 10 above the inner and outer coils 12 and 14 respectively to concentrically surround the leg of the iron core 10 and overspreaded over the coils 12 and 14. The trough 16 is provided at the bottom with a multitude of small holes and filled with a condensible refrigerant 18. The refrigerant 18 drops through the multitude of the small holes to sprinkle on the upper surface of the uppermost coil section of each coil 12 or 14 and then successively trickles down along the inner and outer peripheral surfaces of the coil sections forming each coil 12 or 14 as shown in FIGS. 1 and 2.

In operation, the inner and outer coils 12 and 14 generate heat but the refrigerant 20 trickles down along the inner and outer peripheral surfaces of each coil 12 or 14 to be vaporized. At that time refrigerant 18 removes a latent heat of vaporization thereof from the coils 12 and 14 to cool the coils.

However, the refrigerant 18 trickles only along the inner and outer peripheral surfaces of each coil 12 and 14 but is difficult to enter the gaps 12*a* and 14*a*. Thus only the inner and outer peripheral surfaces of each coil section can be cooled. This has resulted in the disadvantage that the cooling effect is poor.

The present invention contemplates to provide a static induction apparatus improved in cooling effect.

Figure 3:
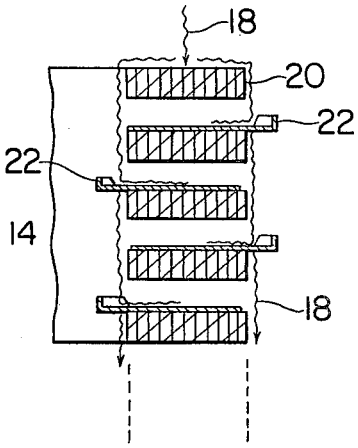
FIG. 3 is a fragmental front elevational view of a portion of one embodiment according to the static induction apparatus of the present invention.

FIG. 3 shows one embodiment according to the static induction apparatus of the present invention but illustrated a single coil and a refrigerant flowing along the coil. The arrangement illustrated comprises a single coil 20 inductively disposed on an iron core (not shown) or the inner core 12 (not shown) having a predetermined inside diameter and a predetermined outside diameter. As in the arrangement shown in FIGS. 1 and 2, the coil 22 includes a plurality of pancake coil sections wound around one leg of the iron core (not shown) or the inner coil 12 shown in FIG. 1 but not shown in FIG. 2 to form a predetermined annular spacing therebetween and stacked on one another lengthwise of the leg or the inner core to leave a predetermined equal axial gaps between the adjacent coil sections respectively with coil sections serially connected to one another although this connection is not illustrated. In this example it is assumed that the coil 20 is the outer coil 16 shown in FIG. 1.

Then a plurality of guide members 22 in the form of rectangular strips composed of an electrically insulating material are radially disposed at predetermined equal angular intervals on the upper surface as viewed in FIG. 3 of each coil section except for the uppermost coil section as viewed in FIG. 3 so that the guide members 22 disposed on alternate ones of the coil sections radially protrude beyond one of outer and inner peripheral surface thereof and the guide members 22 disposed on the remaining coil sections radially protrude beyond the other of outer and inner peripheral surfaces thereof. For example, the guide members 22 disposed on the upper surfaces of the second, fourth, . . . coil sections reckoned from the uppermost coil sections radially outward protrude in axially aligned relationship beyond the outer peripheral surfaces thereof while the guide members 22 disposed on the upper surfaces of the third, fifth, . . . coil sections reckoned from the uppermost coil section radially inward protrude in axial aligned relationship beyond the inner peripheral surfaces thereof as shown in FIG. 3. Also the guide members 22 terminates substantially at the peripheral surface of the mating coil section opposite to peripheral surface thereof beyond which the same radially protrudes. For example, the guide members disposed on the second, fourth, . . . coil sections terminate substantially at the inner peripheral surfaces thereof.

Figure 5:
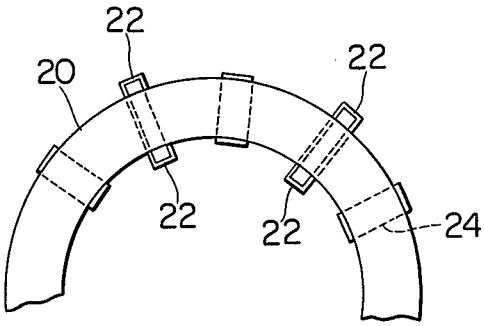
FIG. 5 is a fragmental plan view of the embodiment shown in FIG. 3.

As shown also in FIG. 5, the guide members 22 protruding beyond the outer peripheral surfaces of each of the alternate coil sections are radially aligned with the guide members 22 protruding beyond the inner peripheral surfaces of the adjacent coil section respectively.

Figure 4:
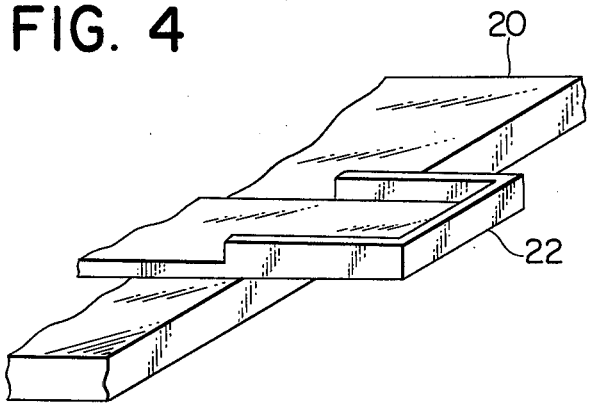
FIG. 4 is a fragmental enlarged view of the guide member and the mating portion of the coil section shown in FIG. 3.

As shown best in FIG. 4, that end portion of each guide member 22 protruding beyond the peripheral surface of the associated coil section is surrounded by side walls erected at three edges thereof and opening toward the other end thereof to form a reception area having a predetermined depth for the purposes as will be apparent later.

In order to maintain the axial gap between each pair of adjacent coil sections at the predetermined magnitude, a plurality of spacers 24 of an electrically insulating material having the thickness of that predetermined magnitude are radially inserted at predetermined equal angular intervals into each gap to alternate the guide member 22 as shown in FIG. 5. At that time each of the spacer 24 has preferably a radial length sufficient to cause both end portions thereof to slightly protrude beyond the outer and inner peripheral surfaces of the mating coil section respectively as shown in FIG. 5.

As described above in conjunction with FIGS. 1 and 2, the refrigerant 20 is sprinkled on the upper surface of the uppermost coil section (see FIG. 3) to be vaporized to cool that upper surface and then the refrigerant in the form of a liquid trickles down along the inner and outer peripheral surfaces of the stacked coil sections one after another. During the trickling thereof the refrigerant in the form of drops are received by the reception areas of the guide members 22 thereof radially protruding beyond the outer and inner peripheral surfaces of the succeeding coil sections to flow radially inward and outward respectively while it cools the upper surfaces of the mating coil sections.

From the foregoing it will readily be understood that a desired number of the guide members 22 may be disposed at predetermined equal angular intervals on the upper surface of each of the coil sections except for the uppermost coil section to alternate the spacers 24 disposed between an associated pair of adjacent coil sections to maintain the gap therebetween at the predetermined magnitude.

Figure 6:
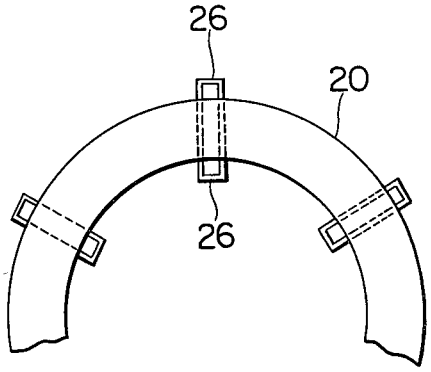
FIG. 6 is a view similar to FIG. 5 but illustrated a modification of the present invention.

The arrangement illustrated in FIG. 6 is different from that shown in FIG. 5 only in that in FIG. 6 the guide member 22 has a predetermined thickness required for each pair of adjacent coil sections to be spaced from each other by the predetermined gap with the spacers 24 omitted.

More specifically each of the guide members 22 includes, in addition to the end portion formed into the reception area as described above, a plurality of discrete protuberances having predetermined heights equal to the axial gap between the adjacent coil sections and erected at each of the opposite edges of a selected part of that portion thereof located within the mating gap. The discrete protuberances at each of the edges of the guide member 22 are substantially opposite to those at the other edge.

From the foregoing it is seen that the present invention is constructed so that a plurality of pancake coil sections are stacked on one another to leave a predetermined gap between each pair of adjacent coil sections and a plurality of guide members are axially disposed on the upper surface of each of the coil sections except for the uppermost coil section, in such a manner that the guide members alternately protrude beyond the outer and inner peripheral surfaces of the coil sections to introduce a refrigerant into the associated gaps between the adjacent coil sections. Thus each of the coil sections is sufficiently cooled resulting in the enhancement of the cooling effect.

While the present invention has been illustrated and described in conjunction with a few preferred embodiments thereof it is to be understood that numerous changes and modifications may be resorted to without departing from the spirit and scope of the present invention. For example, the present invention has been illustrated and described in conjunction with the guide members disposed on a plurality of coil sections forming an outer coil but it is to be understood that the same is not restricted thereto or thereby and equally applicable to either or both of an inner and an outer coil large in the generation of heat. Also it is to be understood that present invention is equally applicable to what includes a single coil such as reactor.

What is claimed is:

1. A static induction apparatus comprising an iron core, at least one coil wound around a leg of the said iron core and cooled by a condensible refrigerant sprinkled thereon, said coil including a plurality of pancake coil sections axially stacked on one another to form a predetermined gap between each pair of adjacent coil sections, and a plurality of guide members radially disposed at predetermined equal angular intervals on the surface of each of said coil sections except for the uppermost coil section so that said guide members disposed on alternate ones of said coil sections radially protrude beyond one of an outer and an inner peripheral surface thereof and said guide members disposed on the remaining coil sections radially protrude beyond the other of said outer and inner peripheral surfaces thereof, each of said guide members receiving drops of said refrigerant to introduce the received refrigerant into said predetermined gap between an associated pair of adjacent coil sections.

2. A static induction apparatus as claimed in claim 1 wherein each of said guide members is in the form of a rectangular strip and one end portion thereof radially protruding beyond said peripheral surface of the mating coil section includes side walls surrounding the same except for side thereof facing the other end thereof to form a reception area having a predetermined depth to receive said drops of said refrigerant, and a plurality of spacers in the form of rectangular strips are radially disposed at predetermined equal angular intervals between each pair of adjacent coil sections to maintain said predetermined gap, spacers alternating the associated guide members.

3. A static induction apparatus as claimed in claim 1 wherein each of said guide members is in the form of a rectangular strip and one end portion thereof radially protruding beyond said peripheral surface of the mating coil section includes side walls surrounding the same except for side thereof facing the other end thereof to form a reception area having a predetermined depth to receive said drops of said refrigerant and each of said guide members and has further a predetermined height equal to the predetermined gap between each said of adjacent coil sections.

* * * * *